United States Patent [19]

Dulian et al.

[11] Patent Number: 4,485,856

[45] Date of Patent: Dec. 4, 1984

[54] APPARATUS FOR ACCURATELY FILLING BEVERAGE CANS

[75] Inventors: Robert J. Dulian, Chicago; David M. Kemp, Naperville; Hartl R. Jones, Bensenville, all of Ill.; Raymond J. Conway, Mountain View, Calif.

[73] Assignee: FMC Corporation, Chicago, Ill.

[21] Appl. No.: 362,868

[22] Filed: Mar. 29, 1982

[51] Int. Cl.[3] ..... B65B 57/00

[52] U.S. Cl. ..... 141/198; 141/95; 137/386; 250/577

[58] Field of Search ..... 141/198, 301, 302, 285, 141/94–96; 137/386, 558; 250/577

[56] References Cited

U.S. PATENT DOCUMENTS

| | | | |
|---|---|---|---|
| 3,167,098 | 1/1965 | Hayden et al. | 141/198 |
| 3,561,503 | 2/1971 | Rogge | 141/198 |
| 4,246,489 | 1/1981 | Yoshida et al. | 250/577 |

FOREIGN PATENT DOCUMENTS

| | | | |
|---|---|---|---|
| 906609 | 9/1962 | United Kingdom | 250/577 |

OTHER PUBLICATIONS

Brochure entitled "Carbo-Mix With Double Line Filling Manifold For Pre-Mix Tank Handling Operation".

Instruction manual entitled "Mojonnier Instruction Manual, No. 500-27" pp. 40-42.

*Primary Examiner*—Stephen Marcus
*Assistant Examiner*—Ernest G. Cusick
*Attorney, Agent, or Firm*—Louis J. Pizzanelli; Richard B. Megley

[57] ABSTRACT

Apparatus for filling beverage tanks comprising a liquid manifold and a gas manifold for counter-pressurizing the liquid as it fills the tank. Supply conduits connect the tank with the manifolds. The gas supply conduit contains a coupling device for connection to a fill-height tube on the container. This coupling device includes an optical sensor embodying a prism which reflects light from a light source when the tank has liquid below a predetermined level and directs light onto a photo-conductor. When the liquid reaches a predetermined upper level in the tank and is forced into the coupling device through the fill-height tube, the prism changes its reflective characteristics, and light passes through the prism without reflection. The change in reflective conditions is brought about by the liquid covering adjacent sides of the prism. The photo-conductor correspondingly changes an electrical signal that is utilized to operate a solenoid valve for shutting off the liquid to the tank.

1 Claim, 4 Drawing Figures

34
33
6
8
12
10
10
34
12
2
2
4

APPARATUS FOR ACCURATELY FILLING BEVERAGE CANS

BACKGROUND OF THE INVENTION

This invention relates to apparatus for filling tanks with soft drink and like beverages. More particularly, the invention comprises an arrangement for effecting an accurate fill of such tanks.

Beverage containers or tanks of the type with which the present invention is concerned are typically large metal caps which are ultimately used to dispense the beverage at refreshment stands and similar locations. The tanks may be, for example, of five-gallon (19 liter) capacity which are filled with premix or postmix product. When premix is provided, syrup, water and carbon dioxide are first mixed in desired proportions, and the resultant product is delivered to the tanks. When postmix is provided, syrup only is delivered to the tank and the end product is mixed in its final form at the dispensing site.

U.S. Pat. No. 316,098 to Hayden et al. discloses one approach of tank handling apparatus, wherein the fluid, whether premix product or postmix syrup, is supplied through a manifold and hose or supply line, and carbon dioxide is supplied through a gas manifold and hose or supply line. The supply lines for the gas and fluid are each attached by suitable fittings to the tanks, and the tank is first charged with a quantity of carbon dioxide. Thereafter, the liquid is introduced into the tank; the rate of tank filling being controlled by the charge of carbon dioxide already in the tank. A series of tanks may be serviced at one time.

During the tank filling process, the carbon dioxide first is introduced into the tank through a tube and fitting at or near the tank top. Thereafter, the product is introduced through a tube which extends to the tank bottom, so that the rising level of liquid in the tank forces some of the carbon dioxide out of the tank and back through the carbon dioxide supply line. Thus, in order to fill the tank, the pressure of the liquid in the liquid supply line is greater than that of the carbon dioxide in the tank and in the carbon dioxide supply line. When the tank is filled to a predetermined level of liquid, the liquid will enter a fill height tube in the top of the rank. This fill height tube communicates with the carbon dioxide supply line and, in effect, forms an extension or continuation thereof. The rising level of liquid in the fill height tube ultimately closes a check valve which is incorporated in a known manner in the coupler that connects the carbon dioxide supply tube to the fill height tube.

Upon closing of the check valve, carbon dioxide can no longer escape from the carbon dioxide head at the top of the tank. Unless the liquid supply is cut off, the liquid will continue to be supplied to the tank until the tank is filled or until the pressure head developed by the carbon dioxide equals the liquid supply line pressure, and thus becomes sufficient to prevent further filling of the tank with liquid. In general, however, a result of the foregoing procedure is that the tank sometimes overfilled with liquid. In any case, the accuracy of the fill levels obtained by the foregoing arrangement is frequently less than what is desired.

OBJECTS AND SUMMARY OF THE INVENTION

An object of this inventon is to provide a filling apparatus of the general type stated in which a predetermined fill level of liquid in the tank is detected by a sensor in the carbon dioxide supply line coupler for the tank, whereupon the supply of liquid from the product manifold is quickly shut off, thereby insuring that an accurate predetermined amount of premix beverage or postmix syrup will then be in the tank.

A further object of this invention is to provide an apparatus of the type stated that utilizes an electro-optical sensor in the gas supply line coupler to the tank. The sensor provides a signal to a control circuit which, in turn, actuates a solenoid valve to shut off the supply of liquid from the supply manifold to the tank.

In accordance with the foregoing objects, the invention comprises a liquid manifold, a gas manifold, a supply conduit connected to each manifold for supplying gas and product independently to each container being filled, coupler means for connecting each conduit to the container, and a valve in the liquid supply conduit for controlling the flow of liquid from the liquid manifold to the container. A sensing device in the coupler is associated with the gas conduit and operates to sense when the liquid in the container reaches a predetermined level of fill. Means responsive to the operation of the sensing device, upon said level being reached, closes the valve. The sensing device comprises means for changing an electrical signal when said level has been reached, and means for utilizing that change in electrical signal to effect closing of the valve.

Also in accordance with the objects, this invention provides a coupler for attachment to a beverage container. The coupler embodies a sensor comprising a source of light, a photo-responsive device, and a prism interposed in the optical path between the source of light and the photo-responsive device. In the absence of contact of the prism by liquid rising into the coupler from the fill height tube, a relatively large amount of light is reflected from the source by the prism to impinge upon the photo-responsive device to cause it to respond. Under these conditions, the electrical circuitry maintains the liquid fill valve in an open condition. However, when liquid contacts and surrounds the prism, little light is reflected to the photo-responsive device. This changes the electrical signal, and the change in signal is utilized to actuate the solenoid valve that controls the liquid supply manifold.

DETAILED DESCRIPTION

Figure 1:
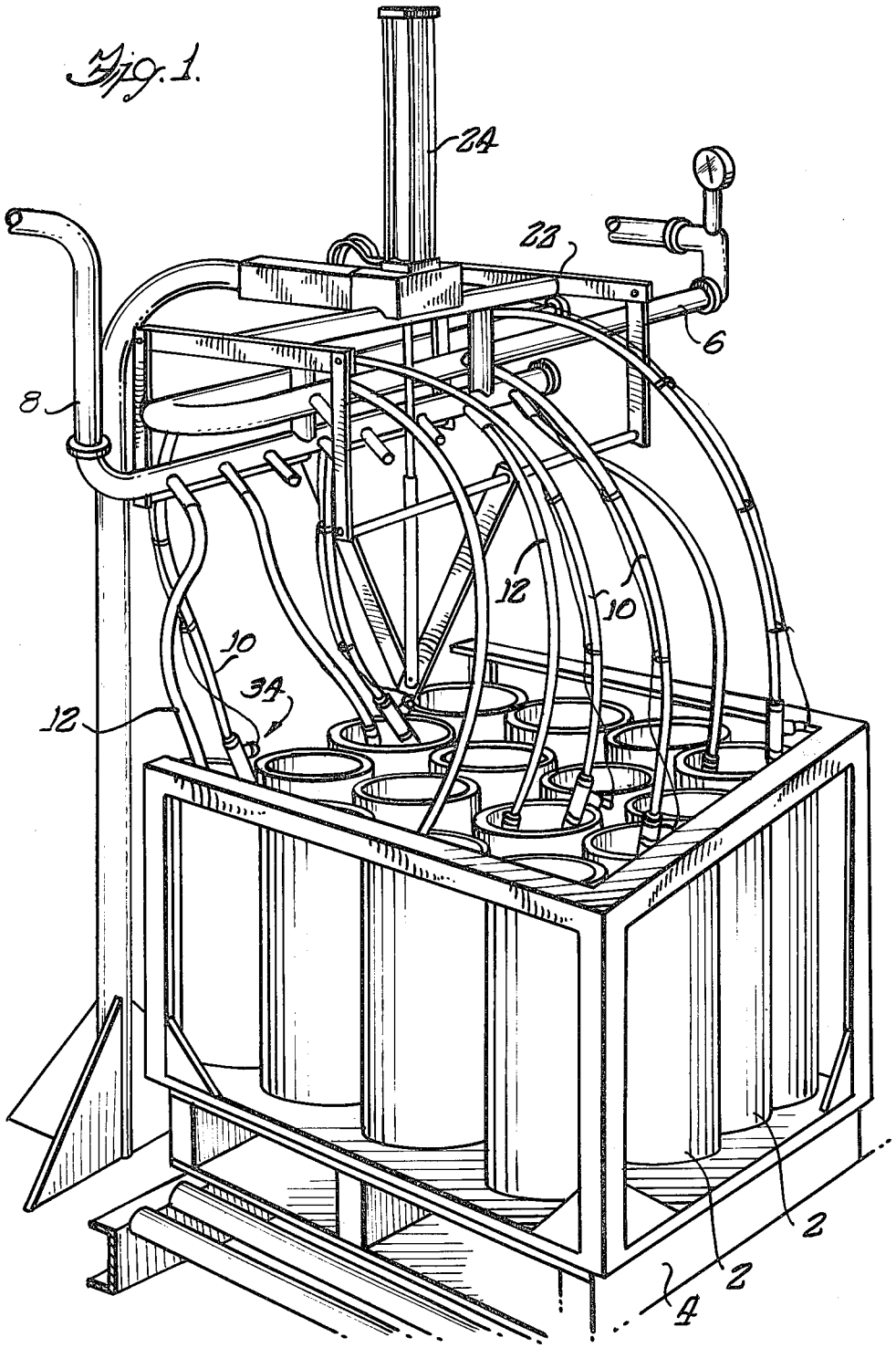
FIG. 1 is a perspective view of a container or tank filling arrangement which embodies the present invention.
Figure 2:
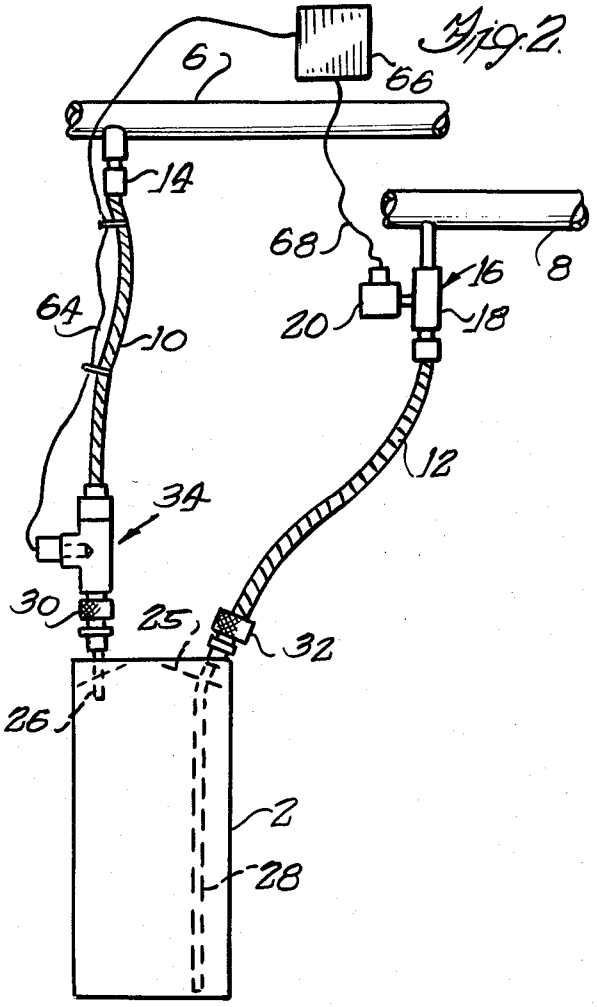
FIG. 2 is a fragmentary elevational view showing the arrangement of the invention as applied to an individual tank.

Referring now in more detail to the drawings, FIG. 1 shows a representative arrangement for filling containers or tanks 2. In the arrangement shown there are a number of tanks 2 which are supported on a skid or pallet 4, the pallet or skid 4 being of conventional construction. Above the tops of the tanks 2 is a structure 22 that supports a gas manifold 6 for supplying carbon dioxide to the tanks 2, and a product manifold 8 for supplying liquid such as premix or postmix to the tanks 2. Each tank is connected to the manifolds 6 and 8 by flexible supply conduits 10, 12. Conduit 10 is a gas supply conduit while conduit 12 is a liquid-product supply conduit. The respective conduits 10, 12 may be connected to the manifolds 6, 8 through conventional couplings devices 14, 16 as shown in FIG. 2, the latter including a valve 18 which is operated by a solenoid 20. When the valve 18 is closed, the flow of product from the manifold 8 to the conduit 12 is cut off. The illustrated arrangement for filling a number of containers or tanks 2 is merely representative, it being understood that the tanks may be handled and filled as a group, or individually, and that the manifolds can be arranged or constructed in a number of ways. In the illustrated embodiment, the hoses connected to the manifolds 6, 8 may be positioned above the structure 22. This structure 22 may be raised and lowered by an air cylinder 24 to raise the conduits 10, 12 away from the tanks while the pallet is being moved under the manifolds.

Referring now more particularly, to FIG. 2 it will be seen that the conical top wall 25 of the tank 2 has a fill height tube 26 which projects into the interior of the tank and also upwardly therefrom above the tank top wall. The length of the tube 26 is relatively short. Also mounted in the top wall of the tank 2 is a product fill tube 28 which terminates at its lower end in closely spaced relationship to the bottom of the tank 2. The lower ends of the conduits 10, 12 are provided with coupling devices 30, 32 which couple onto mating coupling structure at the upper ends of the tubes 26, 28. Because the foregoing coupling arrangement is conventional, it need not be described in detail.

Figure 3:
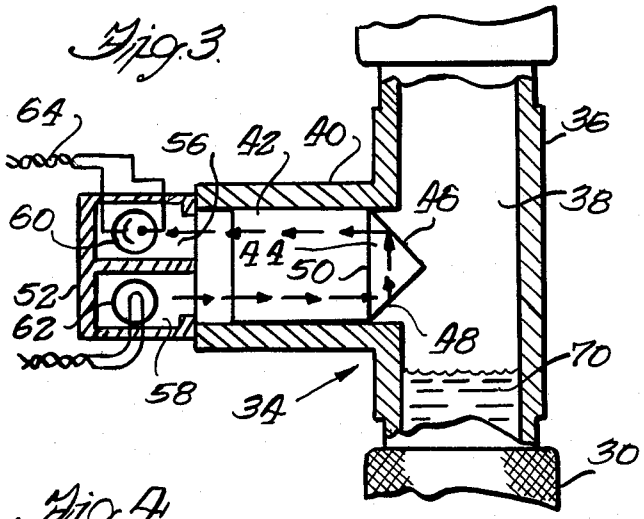
FIG. 3 is an enlarged fragmentary sectional view through the gas supply line coupler and showing the operation of the sensor when the liquid level in the tank is below a predetermined amount.
Figure 4:
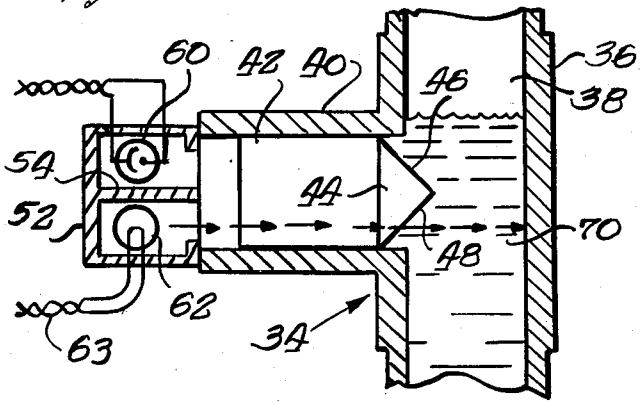
FIG. 4 is a view similar to FIG. 3 and showing the operation of the sensor when the level of liquid product in the tank has reached a predetermined desired amount.

Embodied in the coupling device 30 is a sensing device 34 which forms part of the present invention, and which is shown in more detail in FIGS. 3 and 4. This sensing device 34 comprises a housing 36 that defines a tubular chamber 38 and which forms part of the flow path of the gas from the gas supply manifold 6 to the interior of the tank 2. In the illustrated embodiment, the housing 36 also includes a radial tubular extension 40, the bore 42 of which is sealed off from the chamber 38 by a prism 44. This prism 44 comprises adjacent sides 46, 48 which intersect to form a 90° angle, and a third side 50 which forms a 45° angle with sides 46, 48 and is presented away from the chamber 38 but toward the bore 42. It will be understood that other arrangements of the housing 36, chamber 38 and prism 46 could be provided.

At its outer end the extension 40 receives a fitting 52 having an opaque barrier wall 54 to divide the fittings chamber into adjacent compartments 56, 58. In the compartment 56 there is a photo-diode 60 or other suitable photo-responsive device, while the compartment 58 houses a light-emitting diode 62 or like source of light powered from conductors 63. The arrangement is such that if sufficient light from the light source 62 impinges upon the photo-diode 60, an electrical signal will be supplied over conductors 64 to an electronic switch/power supply unit 66 (FIG. 2). The unit 66 is conventional.

In use, the conduits 10, 12 are connected through couplers 30, 32 to tubes 26, 28 of the container or tank 2. Each coupler conventionally has a normally closed valve that opens when the coupler is attached and closes when the coupler is detached. Similarly functioning valves are in the tubes 26, 28. Preferably the conduit 10 is connected first so as to counter-pressure the product as it is being supplied through the tube 28. In any case, the product rises in the tank 2 until the lower end of the fill-height tube 26 is reached. A further rise in liquid level compresses the carbon dioxide in the head space above the liquid level and at the same time forces liquid into the tube 26 and into the housing chamber 38 as shown in FIG. 3.

When the level of the fill liquid 70 is below the prism 44, as shown in FIG. 3, light from the diode 62 is reflected by the prism 44 and impinges on the photo-diode 60, as indicated by the arrows. The current generated by the photo-diode 60 is routed by the conductors 64 to the unit 66. However, when the liquid covers the prism surfaces 46, 48 as shown in FIG. 4, the reflective characteristics of the prism 44 change, and much less of the light from the light souce 62 is reflected back to the photo-diode 60. Most of the light is refracted and leaves the prism, as indicated. This great reduction in sensed light greatly reduces or changes the signal transmitted to the discriminator circuit in the unit 66. When the unit 66 is thus not satisfied, voltage is applied through line 68, and the solenoid 20 is closed, thereby closing the valve 18 and immediately halting flow of fluid into the tank 2. In this way, the flow of fluid into each tank 2 is halted when fluid from that tank rises into the sensor 34. If desired, the unit 66 can be provided with an indicator such as a light so as to signal the machine operator when all the tanks have been filled The invention is claimed as follows:

1. In a system for the filling of a pressurized beverage container including a source of gas at a selected positive pressure and a source of beverage liquid at a pressure greater than the gas pressure, flexible conduits respectively connected to the source of gas and to the source of liquid and to fluid tight fittings on said container to supply gas and liquid separately thereto, each said gas and said liquid conduit being provided with respective gas and liquid valves operative to open when connected to the fittings of the container, with the container being initially connected to the gas conduit to effect gas pressurization, and thereafter to the higher pressure liquid conduit to effect filling of the container, and a sensing device in said gas conduit to determine when beverage liquid is present in said gas conduit to indicate that a selected level of container fill is achieved, the improvement in said system comprising:

a housing connected between said flexible gas conduit and a said fluid tight fitting, and having a pair of communicating bores, one said bore forming a further portion of said gas conduit and the other said bore containing the means for detecting the presence of liquid in said gas conduit notwithstanding positive gas pressure therein;

said detecting means comprising a light emitter and a light receiving photoconductor; means in the path of said light emitter for refracting the light therefrom and directing it to the photoconductor providing an electrical signal to maintain open the liquid valve controlling the flow of liquid in said conduit connected to the source of liquid, thereby to admit liquid to said container;

said refracting means having two angular refracting faces facing said gas conduit bore with said refracting faces thereof normally immersed in the pressurized gas in said gas conduit bore;

said liquid being supplied through said liquid conduit to the container against the gas positive pressure therein until the gas is displaced therefrom and both said faces of said refracting means in the gas conduit bore are sufficiently immersed in the liquid thereby reducing refraction of the light and the electrical signal produced by the photoconductor thereby to effect closing of the valve in the liquid conduit and thus discontinue flow of liquid to the container.

* * * * *